US007029396B2

(12) United States Patent
Jaffe et al.

(10) Patent No.: US 7,029,396 B2
(45) Date of Patent: Apr. 18, 2006

(54) GAMING MACHINE WITH MYSTERY PAY FEATURE

(75) Inventors: Joel R. Jaffe, Evanston, IL (US); Allon G. Englman, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 10/435,091

(22) Filed: May 9, 2003

(65) Prior Publication Data

US 2004/0224751 A1 Nov. 11, 2004

(51) Int. Cl.
*A63F 9/24* (2006.01)

(52) U.S. Cl. ..... 463/20; 273/139

(58) Field of Classification Search ..... 463/16–22, 463/25, 30, 31, 37; 273/138.1, 139, 143 R
See application file for complete search history.

(56) References Cited

U.S. PATENT DOCUMENTS

| | | | | |
|---|---|---|---|---|
| 5,902,184 | A | 5/1999 | Bennett | 463/13 |
| 6,056,642 | A | 5/2000 | Bennett | 463/20 |
| 6,251,013 | B1 | 6/2001 | Bennett | 463/12 |
| 6,261,178 | B1 | 7/2001 | Bennett | 463/20 |
| 6,419,479 | B1 | 7/2002 | Bennett | 463/20 |
| 6,676,512 | B1 * | 1/2004 | Fong et al. | 463/20 |
| 2002/0052233 | A1 * | 5/2002 | Gauselmann | 463/20 |
| 2002/0119814 | A1 | 8/2002 | Fong et al. | 463/13 |
| 2002/0151351 | A1 | 10/2002 | Baerlocher et al. | 463/20 |
| 2003/0013519 | A1 | 1/2003 | Bennett | 463/25 |
| 2003/0027616 | A1 | 2/2003 | Vancura | 463/16 |
| 2003/0060267 | A1 * | 3/2003 | Glavich et al. | 463/20 |
| 2003/0087688 | A1 * | 5/2003 | Kato | 463/20 |
| 2003/0153382 | A1 * | 8/2003 | Vancura | 463/20 |

FOREIGN PATENT DOCUMENTS

| | | | |
|---|---|---|---|
| EP | 1 418 553 | A2 | 5/2004 |
| GB | 2393018 | A | 3/2004 |
| WO | WO 2001/58546 | A | 8/2001 |

OTHER PUBLICATIONS

British Search Report dated Jan. 10, 2005.

* cited by examiner

*Primary Examiner*—Kim Nguyen
(74) *Attorney, Agent, or Firm*—Jenkens & Gilchrist

(57) ABSTRACT

A method of conducting a wagering game on a gaming machine is disclosed. The wagering game includes a pay table defining awards and combinations of award symbols associated with the respective awards. After a player makes a wager, a plurality of symbol-bearing reels are rotated and stopped to place symbols on the reels in visual association with at least one active pay line. If the stopped reels include a combination of mystery symbols along the active pay line, one of the award symbols is randomly selected to replace the mystery symbols. The game provides an award associated with the combination of the selected award symbol, as defined by the pay table.

27 Claims, 5 Drawing Sheets

GAMING MACHINE WITH MYSTERY PAY FEATURE

FIELD OF THE INVENTION

The present invention relates generally to gaming machines and, more particularly, to a gaming machine with a mystery pay feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent and extended play and hence increase profitability to the operator. Accordingly, in the competitive gaming machine industry, there is a continuing need for gaming machine manufacturers to produce new types of games, or enhancements to existing games, which will attract frequent and extended play by enhancing the entertainment value and excitement associated with the game.

SUMMARY OF THE INVENTION

A method of conducting a wagering game on a gaming machine is disclosed. The wagering game includes a pay table defining awards and combinations of award symbols associated with the respective awards. After a player makes a wager, a plurality of symbol-bearing reels are rotated and stopped to place symbols on the reels in visual association with at least one active pay line. If the stopped reels include a combination of mystery symbols along the active pay line, one of the award symbols is randomly selected to replace the mystery symbols. The game provides an award associated with the combination of the selected award symbol, as defined by the pay table.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings in which.

Figure 1:
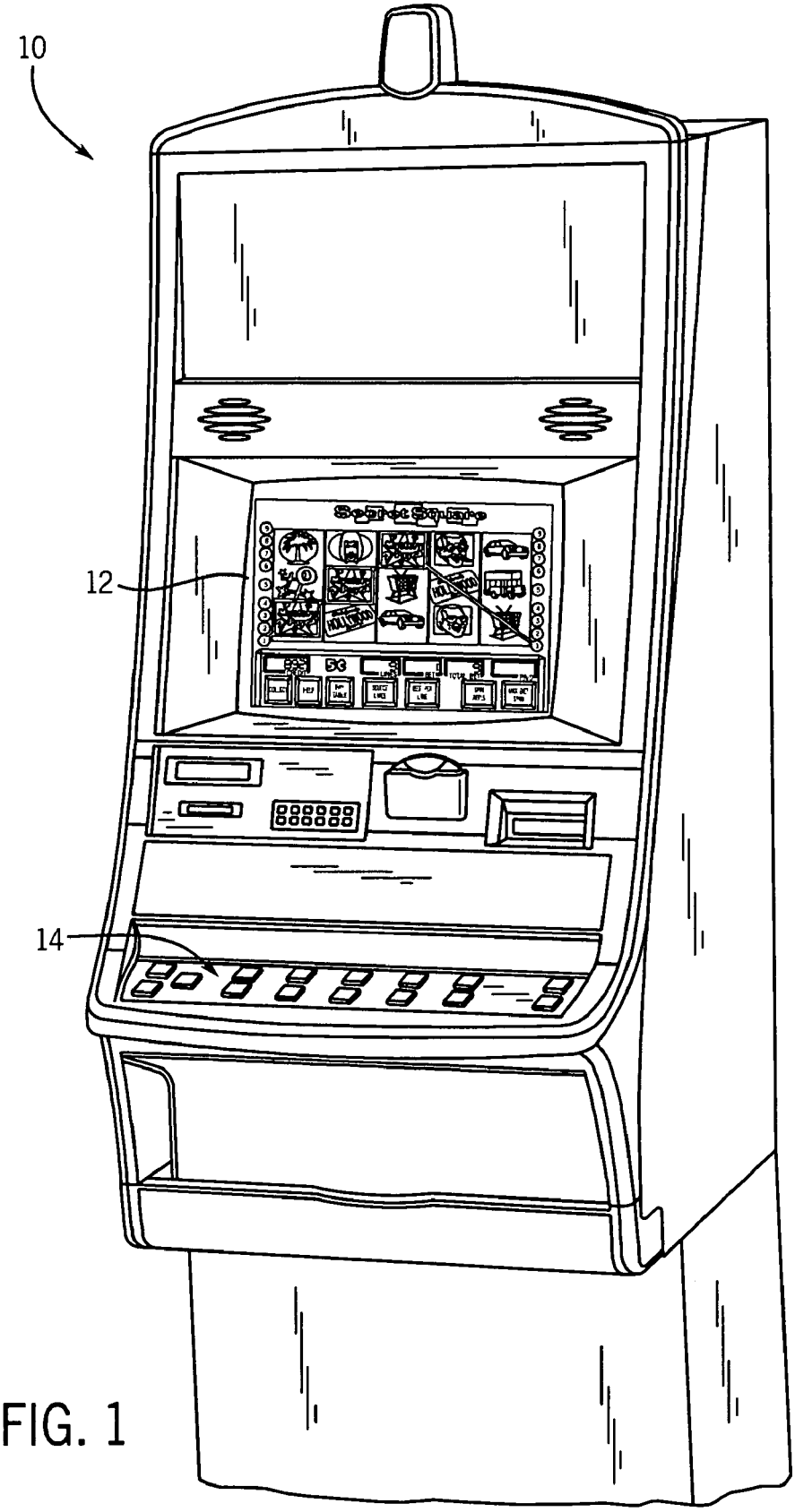
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a gaming machine 10 is operable to play a wagering game. The wagering game includes a basic video reel slot game and a mystery pay feature triggered by a combination of Mystery Pay symbols along an active pay line. In addition to the mystery pay feature, the basic slot game may produce certain outcomes for triggering other special features and bonus games.

The gaming machine 10 includes a visual display 12 preferably in the form of a cathode ray tube (CRT), liquid crystal display (LCD), plasma, or other type of video display known in the art. The display 12 preferably includes a touch screen overlaying the monitor. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
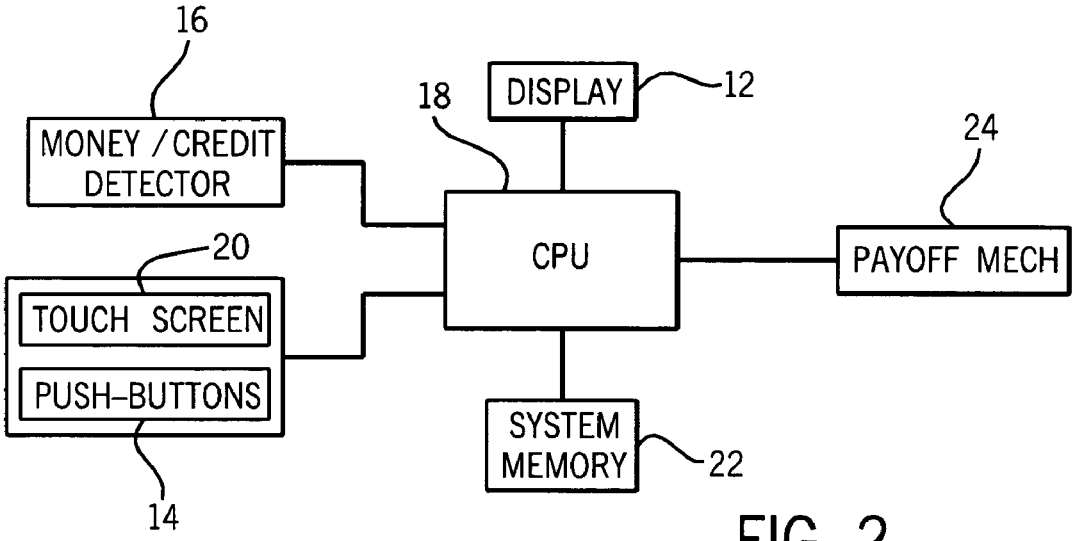
FIG. 2 is a block diagram of a control system suitable for operating the gaming machine.

FIG. 2 is a block diagram of a control system suitable for operating the gaming machine 10. Money/credit detector 16 signals a central processing unit ("CPU") 18 when a player has inserted money or played a number of credits. The money may be provided by coins, bills, tickets, coupons, cards, etc. Then, the CPU 18 operates to execute a game program that causes the display 12 to display five simulated symbol-bearing reels. The player may select a number of pay lines to play, an amount to wager, and start game play via the touch screen 20 or the push-buttons 14, causing the CPU 18 to set the reels in motion, randomly select a game outcome, and then stop the reels to display symbols corresponding to the pre-selected game outcome. In accordance with the present invention, a combination of three or more Mystery Pay symbols along an active pay line triggers a mystery pay feature.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to certain winning outcomes that might occur in the basic game or the mystery pay feature. The payoff may be provided in the form of coins, bills, tickets, coupons, cards, etc. The payoff amounts are determined by one or more pay tables stored in the system memory 22.

Figure 3:
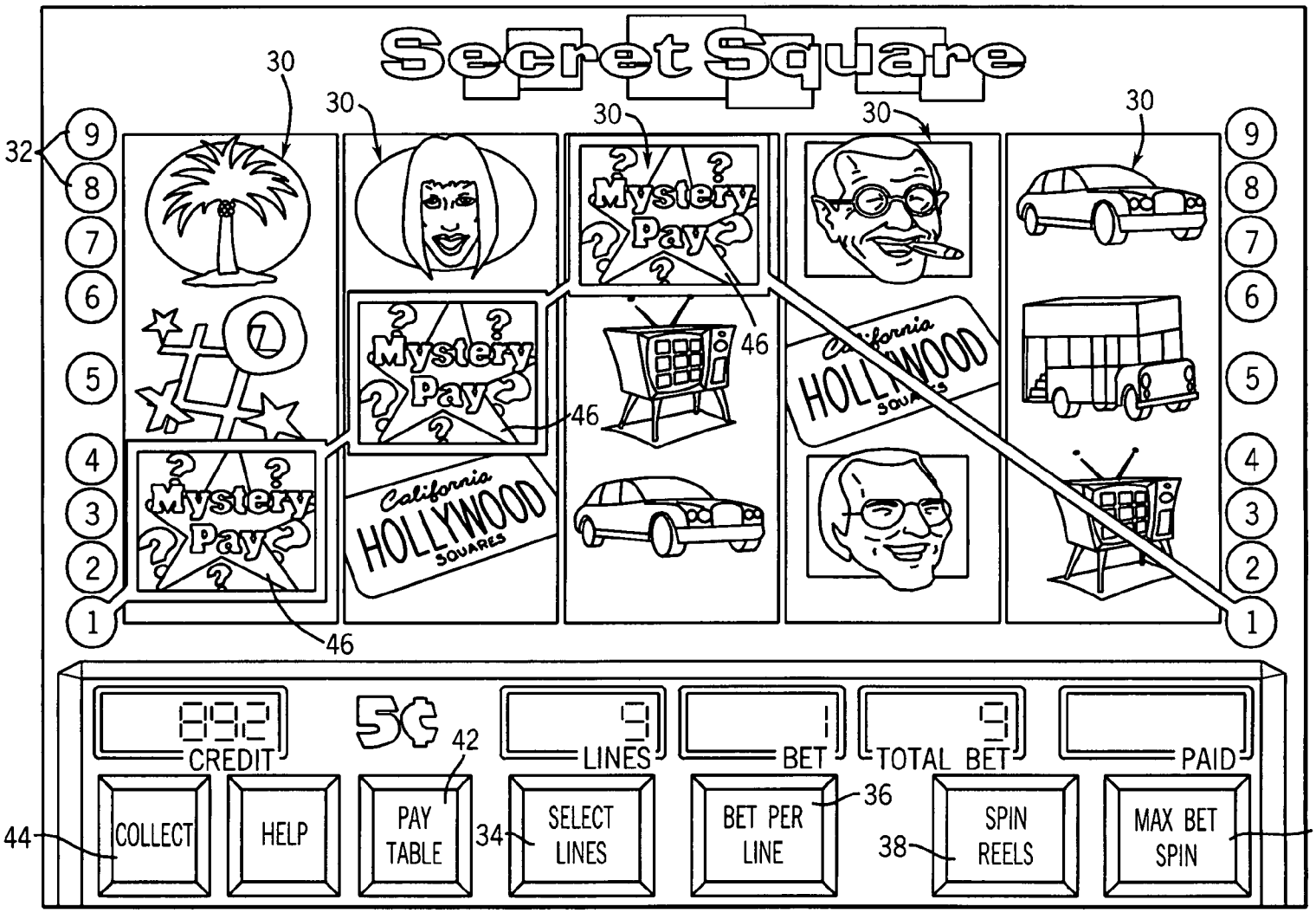
FIG. 3 is a display image associated with a basic slot game and showing a symbol combination for triggering a "first screen" mystery pay feature.

Referring to FIG. 3, a basic video slot game is implemented on the display 12 on simulated reels 30 that are rotated and stopped to place symbols on the reels 30 in visual association with a number of pay lines 32. In the illustrated example, the number of reels 30 is five and the number of pay lines 32 is nine. The number of reels and pay lines may, however, be varied to be more or less than the number illustrated. Also, the video display 12 may be replaced with a mechanical display including a number of physical reels driven by stepper motors. Each of the pay lines 32 extends through one symbol on each of the reels 30.

Generally, game play is initiated by inserting money or playing a number of credits, causing the CPU to activate a number of pay lines corresponding to the amount of money or number of credits played. In one embodiment, the player selects the number of pay lines (between one and nine) to play by pressing a "Select Lines" key 34. The player then chooses the number of coins or credits to wager on the selected pay lines by pressing a "Bet Per Line" key 36. After selecting a number of pay lines and a wager amount, the reels 30 may be set in motion by touching a "Spin Reels" key 38 or, if the player wishes to bet the maximum amount per line, by using a "Max Bet Spin" key 40. Alternatively, other mechanisms such as a lever or push button may be used to set the reels in motion.

The CPU uses a random number generator to select a game outcome (e.g., "basic" game outcome) corresponding to a particular set of reel "stop positions." The CPU then causes each of the video reels 30 to stop at the appropriate stop position. Video symbols are displayed on the reels 30 to graphically illustrate the reel stop positions and indicate whether the stop positions of the reels represent a winning game outcome.

A pay table identifies winning basic game outcomes (e.g., symbol combinations resulting in an award of credits or a bonus game) and the awards associated with such outcomes. In one embodiment, the pay table is affixed to the machine 10 and/or displayed by the video display 12 in response to a command by the player (e.g., by pressing a "Pay Table" button 42). A winning basic game outcome occurs when the symbols appearing on the reels 30 along an active pay line correspond to one of the winning combinations on the pay table. A winning combination, for example, could be three or more matching symbols along an active pay line, where the award is greater as the number of matching symbols along the active pay line increases. If the displayed symbols stop in a winning combination, the game provides the award identified in the pay table for that combination. If the award is a number of credits, the game typically multiplies that number of credits by the number of credits wagered on the winning pay line. In the illustrated example, relevant portions of the pay table screens and instructional text appear below:

Winning line pay combinations pay left to right only.

[Logo] is wild for all symbols except [TV Set] [Wheel] or [Award Statue]

| | | | |
|---|---|---|---|
| | <Logo> | | <George Burns> |
| 5000 | [S][S][S][S][S] | 500 | [S][S][S][S][S] |
| 500 | [S][S][S][S] | 200 | [S][S][S][S] |
| 100 | [S][S][S] | 40 | [S][S][S] |
| 5 | [S][S] | 2 | [S][S] |
| 2 | [S] | | |
| | <Paul Lynde> | | <Loni Anderson> |
| 300 | [S][S][S][S][S] | 300 | [S][S][S][S][S] |
| 100 | [S][S][S][S] | 100 | [S][S][S][S] |
| 25 | [S][S][S] | 25 | [S][S][S] |

Winning line pay combinations pay left to right only.

[Logo] is wild for all symbols except [TV Set] [Wheel] or [Award Statue]

| | | | |
|---|---|---|---|
| | <Limo> | | <Palm> |
| 200 | [S][S][S][S][S] | 150 | [S][S][S][S][S] |
| 50 | [S][S][S][S] | 50 | [S][S][S][S] |
| 10 | [S][S][S] | 10 | [S][S][S] |
| | <Glasses> | | |
| 100 | [S][S][S][S][S] | | |
| 30 | [S][S][S][S] | | |
| 5 | [S][S][S] | | |

Only highest winner paid per winning combination. All line pays are multiplied by the line bet.

Wins from left must occur on adjacent reels, beginning with the leftmost reel.

Mystery Pay Bonus:

3 or more [Mystery Pay] on an active pay line trigger the Mystery Pay bonus.

Pick a star below the reels to reveal one of the nine possible reel symbols from the game.

The selected symbol now replaces all the Mystery Pay symbols on the pay line that triggered the bonus.

Circle of Stars Bonus:

3 or more [Circle of Stars] trigger the Circle of Stars Bonus.

. . .

Tour of Stars Bonus:

3 or more [Tour Buses] on an active pay line trigger the Tour of Stars Bonus.

. . .

The player may collect the amount of accumulated credits by pressing a "Collect" button 44. In the illustrated example, the winning combinations start from the leftmost reel and span adjacent reels, i.e., winning line pay combinations pay left to right only. In an alternative implementation, the winning combinations start from either the leftmost reel or the rightmost reel and span adjacent reels, i.e., winning line pay combinations pay left to right and right to left.

Included among the plurality of basic game outcomes are start-feature outcomes for triggering play of different special game features. The special game features may, for example, include the mystery pay feature and bonus games such as those referenced in the above pay table screens. A start-feature outcome may be defined in any number of ways. For example, a start-feature outcome occurs when a special start-feature symbol or a special combination of symbols appears on one or more of the reels 30. The start-feature outcome may require the combination of symbols to appear along an active pay line, or may alternatively require that the combination of symbols appear anywhere on the display (i.e., "scattered") regardless of whether the symbols are along an active pay line. The appearance of a start-feature outcome causes the CPU to shift operation from the basic game to the associated special game feature. In the illustrated example, a combination of three or more Mystery Pay symbols 46 along an active pay line 32 triggers the mystery pay feature. The Mystery Pay symbols 46 in the combination may, for example, be highlighted using a flashing border.

Figure 4:
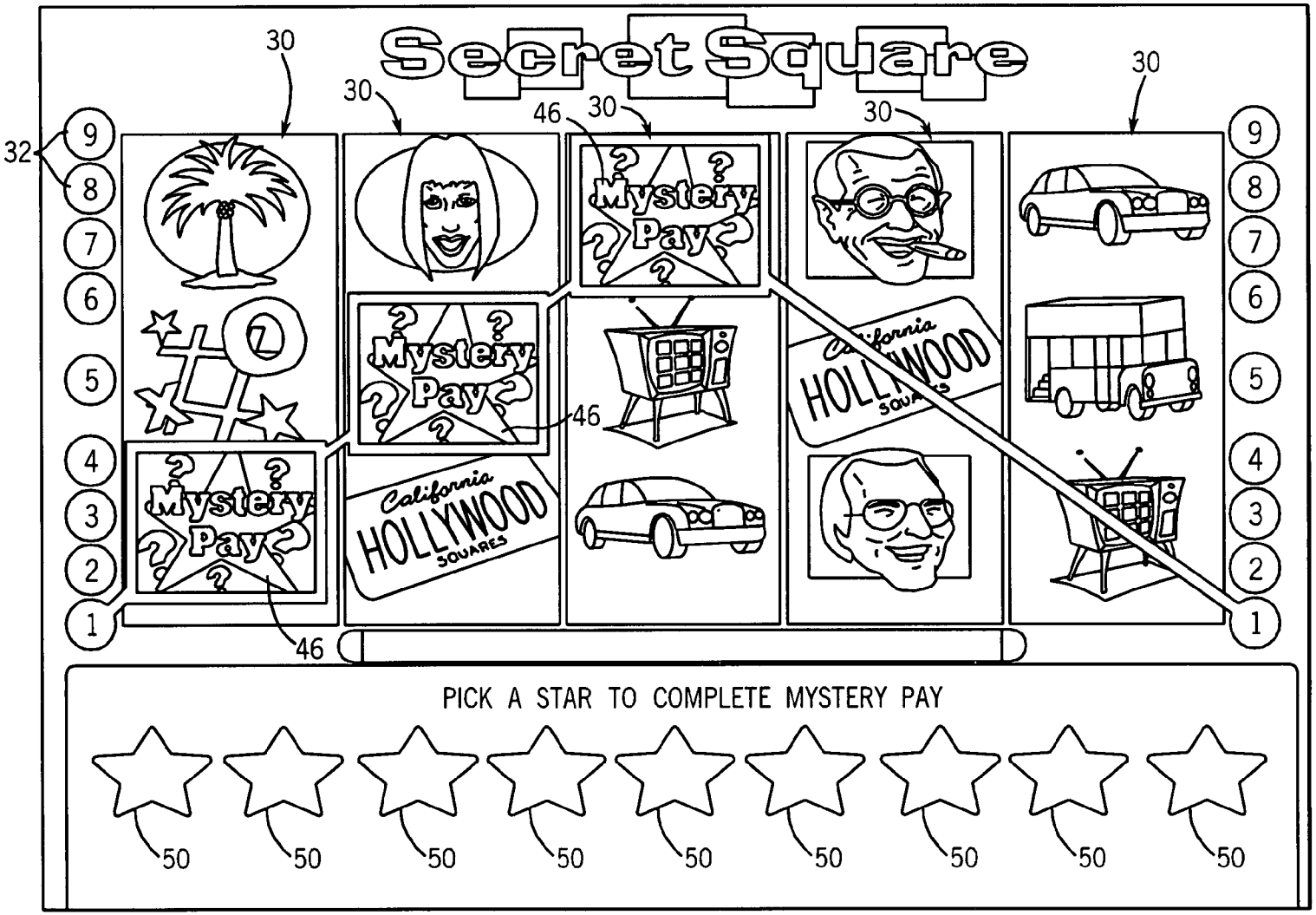
FIGS. 4 and 5 are display images associated with the mystery pay feature.

Referring to FIG. 4, ten stars 50 appear in place of the onscreen button panel. Each star 50 represents one of the reel symbols (other than the Mystery Pay symbol 46). The CPU randomly associates the stars 50 with the reels symbols such that, prior to selection, the player does not know which of the reel symbols are associated with which of the stars 50. The player is prompted to select one of the stars 50. In the illustrated example, the player selects the second star from the left. Because the stars 50 are randomly associated with the reel symbols and the reel symbols are concealed prior to the player's selection, the reel symbol is in effect selected at random even though the player's selection of a star 50 may not be random.

Figure 5:
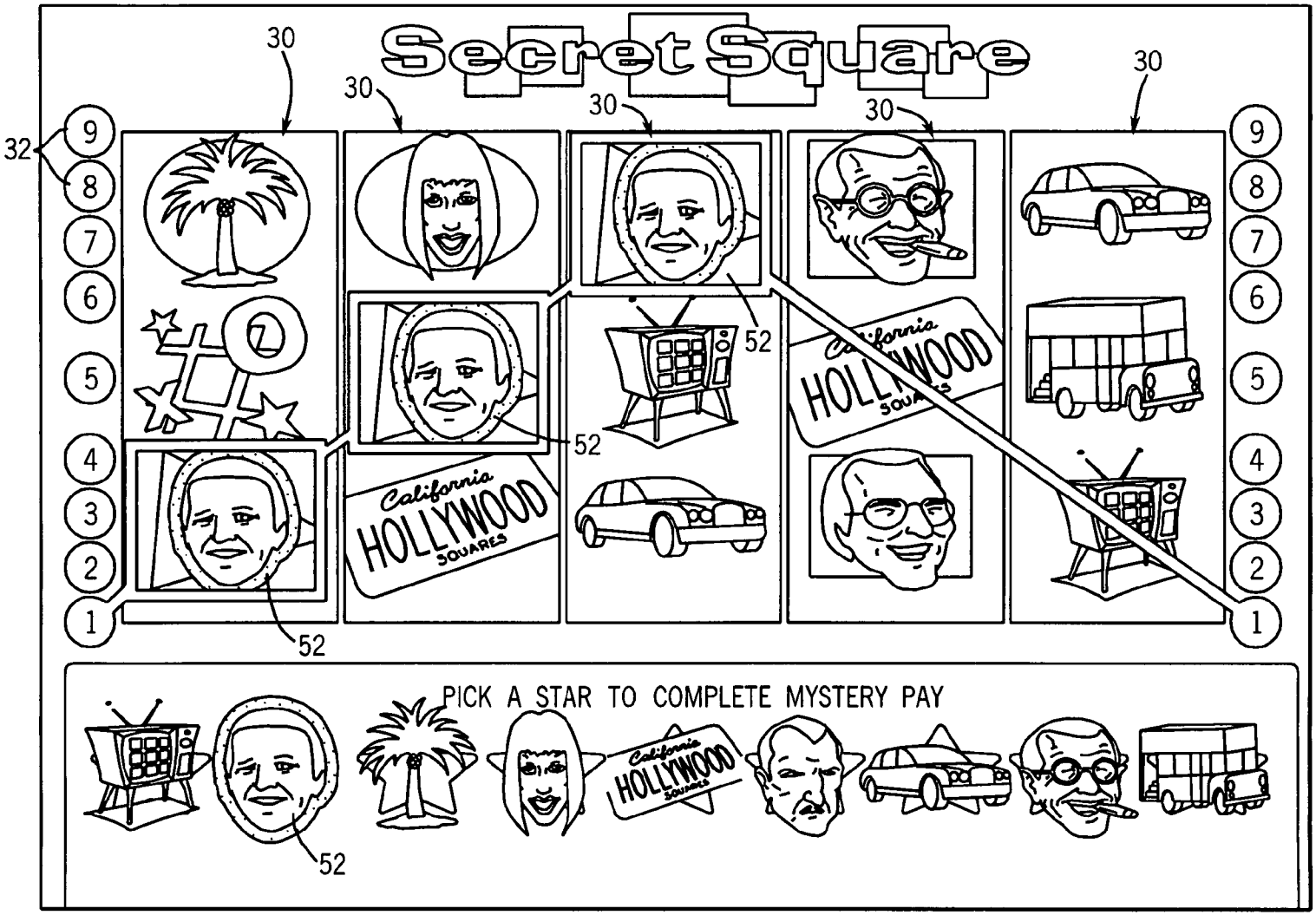

Referring to FIG. 5, the selected star reveals and highlights its associated reel symbol. In the illustrated example, the selected star reveals a Paul Lynde symbol 52. The nine stars that were not selected by the player also reveal their associated reel symbols so that the player can see what he or she would have uncovered by selecting a different star. The unselected reel symbols are preferably displayed in a subdued manner (e.g., grayed out) to distinguish the selected reel symbol 52 from the unselected reel symbols. The Mystery Pay symbols 46 (see FIG. 4) along the active pay line 32 transform or "morph" into the selected reel symbol (e.g., the Paul Lynde symbol 52).

The CPU then evaluates the reel 30 to determine a total award for the reel spin. In the illustrated example, according to the pay table a combination of three Paul Lynde symbols 52 along an active pay line 32 yields an award of 25 credits multiplied by the number of credits wagered on the active pay line 32. Depending upon which of the reel symbols replaces the Mystery Pay symbols 46, the award may range from the lowest pay to the highest pay and may even be a bonus game. For example, if the reel symbol that replaces the Mystery Pay symbols 46 is a Tour Bus symbol, the award would be the Tour of Stars Bonus referenced in the pay table.

While the present invention has been described with reference to one or more particular embodiments, those skilled in the art will recognize that many changes may be made thereto without departing from the spirit and scope of the present invention.

For example, the reel symbol that replaces the Mystery Pay symbols 46 may be randomly selected by the CPU without player involvement. The Mystery Pay symbols 46 may transform to the randomly selected reel symbol.

Also, the predefined number of Mystery Pay symbols 46 for triggering the mystery pay feature may be more or less than three.

Further, the Mystery Pay symbols 46 need not be along an active pay line in order to trigger the mystery pay feature; for example, the Mystery Pay symbols 46 could be scattered.

In addition, the mystery pay feature could be implemented in a mechanical reel slot game by using, for example, a secondary display to indicate a reel symbol that substitutes for the Mystery Pay symbols.

Each of these embodiments and obvious variations thereof is contemplated as falling within the spirit and scope of the claimed invention, which is set forth in the following claims.

What is claimed is:

1. A method of conducting a wagering game, the wagering game defining awards and combinations of award symbols associated with the respective awards, the method comprising:

receiving a wager to play the wagering game;

displaying a symbol array and a plurality of selectable elements, the selectable elements being associated with the award symbols; and if the symbol array includes at least a predefined number of mystery symbols in a predefined arrangement, selecting an element of the selectable elements to have an associated award symbol to replace the mystery symbols, the award symbol associated with the selected element being revealed upon the selection of the selected element.

2. The method of claim 1, wherein the predefined number is three.

3. The method of claim 1, wherein the predefined arrangement is along an active pay line.

4. The method of claim 3, wherein one or more of the combinations of award symbols is along a pay line.

5. The method of claim 1, wherein the selecting step is performed by a player.

6. The method of claim 1, further including providing the award associated with any of the combinations on a pay table resulting from the selecting step.

7. The method of claim 1, wherein the selecting step is performed entirely by a processor.

8. The method of claim 1, further including transforming the mystery symbols to the selected award symbol.

9. The method of claim 1, wherein the awards include credit amounts and a bonus game.

10. The method of claim 1, wherein the displaying step includes rotating and stopping a plurality of symbol-bearing reels.

11. The method of claim 1, wherein the selectable elements are being displayed simultaneously with the award symbols.

12. The method of claim 1, wherein the selectable elements are being displayed in a separate area than the award symbols.

13. The method of claim 1, wherein the award symbols associated with unselected ones of the selectable elements are revealed upon the selection of the selected element.

14. A method of conducting a wagering game, the wagering game including a pay table defining awards and combinations of award symbols associated with the respective awards, the method comprising:

receiving a wager to play the wagering game;

rotating and stopping a plurality of symbol-bearing reels to place symbols on the reels in visual association with at least one active pay line;

displaying a plurality of selectable elements, each one of the selectable elements being associated with a corresponding award symbol;

if the stopped reels include a combination of mystery symbols along the active pay line, selecting one element of the selectable elements to replace the mystery symbols, the corresponding award symbol of the selected element being revealed upon the selection of the selected element; and providing the award associated with the combination of the selected award symbol, as defined by the pay table.

15. The method of claim 14, wherein the combination of mystery symbols includes at least three mystery symbols.

16. The method of claim 14, wherein the selecting step is performed by a player.

17. The method of claim 14, wherein the awards includes credit amounts and a bonus game.

18. A method of conducting a wagering game, the wagering game including award symbols for yielding awards and a mystery symbol, the mystery symbol being distinct from the award symbols, the method comprising:

receiving a wager to play the wagering game;

displaying the mystery symbol and a plurality of selectable elements, the selectable elements being associated with the award symbols;

randomly selecting one of the selectable elements to replace the mystery symbol;

revealing the award symbol associated with the selected element upon the selection of the selected element; and providing the award associated with the selected award symbol.

19. The method of claim 18, wherein the displaying step includes displaying at least three of the mystery symbol.

20. The method of claim 19, wherein the at least three of the mystery symbol are displayed along an active pay line.

21. The method of claim 18, wherein the selecting step includes randomly associating the selectable elements with the award symbols and receiving a selection from a player of one of the elements.

22. The method of claim 18, wherein the selecting step is performed entirely by a processor.

23. The method of claim 18, further including transforming the mystery symbol to the selected award symbol.

24. The method of claim 18, wherein the awards include credit amounts and a bonus game.

25. The method of claim 18, wherein the displaying step includes displaying the mystery symbol in a symbol array having rows and columns of symbols.

26. A method of conducting a wagering game, the wagering game defining awards and combinations of award symbols associated with the respective awards, the method comprising:

receiving a wager to play the wagering game;

displaying a symbol array; and if the symbol array includes at least a predefined number of mystery symbols in a predefined arrangement, selecting an element of a plurality of displayed selectable elements to have an associated award symbol to replace the mystery symbols, the selecting step being performed by a player, the selectable elements being randomly associated with the award symbols, the award symbol associated with the selected element being revealed upon the selection of the selected element.

27. A method of conducting a wagering game, the wagering game including award symbols for yielding awards and a mystery symbol, the mystery symbol being distinct from the award symbols, the method comprising:

receiving a wager to play the wagering game;

displaying the mystery symbol and a plurality of selectable elements, the selectable elements being randomly associated with the award symbols;

randomly selecting one of the selectable elements to replace the mystery symbol, the selecting being performed by a player;

revealing the award symbol associated with the selected element upon the selection of the selected element; and providing the award associated with the selected award symbol.

* * * * *